United States Patent [19]

Bell

[11] Patent Number: 4,823,131

[45] Date of Patent: Apr. 18, 1989

[54] RADAR REFLECTOR

[76] Inventor: Stephen W. Bell, The Old Kennels, Easton, Woodbridge, Suffolk, IP13 0EN, England

[21] Appl. No.: 75,998

[22] Filed: Jul. 21, 1987

[30] Foreign Application Priority Data

Jul. 22, 1986 [GB] United Kingdom ..... 8617912
Jul. 22, 1986 [GB] United Kingdom ..... 8617916

[51] Int. Cl.[4] ..... H01Q 15/00
[52] U.S. Cl. ..... 342/7; 114/326
[58] Field of Search ..... 342/5-7, 342/8; 343/912; 441/20; 114/326; 350/102, 106

[56] References Cited

U.S. PATENT DOCUMENTS

| | | | |
|---|---|---|---|
| 2,721,998 | 10/1955 | Holm | 342/8 |
| 3,103,662 | 9/1963 | Gray et al. | 342/8 |
| 3,310,804 | 3/1967 | Brauer | 342/6 |
| 4,073,568 | 2/1978 | Heasley | 350/102 X |
| 4,096,479 | 6/1978 | Van Buskirk | 342/7 |
| 4,104,634 | 8/1978 | Gillard . | |
| 4,352,106 | 9/1982 | Firth | 342/7 |
| 4,551,726 | 11/1985 | Berg | 342/7 |

FOREIGN PATENT DOCUMENTS

| | | | |
|---|---|---|---|
| 0000447 | 1/1979 | European Pat. Off. . | |
| 1014610 | 8/1957 | Fed. Rep. of Germany | 342/7 |
| 8430647 | 4/1985 | Fed. Rep. of Germany . | |
| 0812376 | 4/1959 | United Kingdom | 342/8 |
| 1468516 | 3/1977 | United Kingdom | 342/7 |
| 2145656 | 4/1985 | United Kingdom . | |

*Primary Examiner*—Thomas H. Tarcza
*Assistant Examiner*—Tod Swann
*Attorney, Agent, or Firm*—Larson and Taylor

[57] ABSTRACT

A radar reflector (4, 5) comprises a hollow, generally spherical or conical radar transmitting housing (6) containing a radar reflecting assembly (10) having a number of trihedral cube corner reflecting elements arranged in strings one above the other and with a number of the strings arranged side-by-side around the inside of the housing (6). The radar reflecting assembly (10) may comprise strings of reflecting elements with the origins of all of the reflecting elements lying on and being arranged around a frusto-conical surface and with all of the reflecting elements facing outwards. Preferably, the radar reflecting assembly (10) comprises at least three strings of single or double-handed helical reflecting element arrays (20) arranged side-by-side.

26 Claims, 5 Drawing Sheets

RADAR REFLECTOR

BACKGROUND OF THE INVENTION

This invention relates to reflectors for reflecting radar signals so that they return substantially parallel to their angle of incidence. The simplest of these is the well known octahedral reflector which comprises three sheets of electrically conducting material arranged mutually orthogonally to one another and intersecting one another to provide eight trihedral re-entrant corners having a common geometric origin. Each trihedral re-entrant corner reflects a radar beam which enters that corner reasonably close to its axis at substantially its incident angle. When the incident radar signal arrives at an angle with respect to the axis of the trihedral re-entrant corner reflector the magnitude of the signal reflected back along the path of the incident signal falls off rapidly and falls off even more rapidly at incident angles greater than 20°. With a standard octahedral reflector there are only eight trihedral corners attempting to cover the entire $4\pi$ solid angle and, consequently there are large regions over which no effective reflection takes place from such an octahedral reflector even allowing for the contribution made by the dihedral reflecting components and the flat plates individually.

In an attempt to overcome the limitations of this conventional device, radar reflectors consisting of a single hand or double handed helical array of trihedral re-entrant corner reflecting elements have been produced. Such radar reflectors are illustrated in, for example, GB-A No. 681666 and EP-A No. 0000447, respectively. In such arrays the origins of the trihedral reflecting elements are located around a cylinder. Such reflectors are generally successful particularly for use on sailing boats in which they can be hoisted high into the rigging and so hoisted to a considerable height above the surface of the sea. They have also been used for other marine purposes such as navigational buoys. One of the difficulties encountered with conventional reflectors is being able to discriminate the echo from the reflector from a high background clutter. Another problem is caused by sea surface specular reflection as a result of a calm sea or ice. In this case phase cancellation occurs between the incident radar signal arriving directly from the transmitter and a radar signal which is reflected from the surface of the sea before its arrival at the reflector. These signals are separated by only a very small angle when the reflector is close to the sea surface. When such signals are presented to a single reflective corner, dihedral, or flat plate, no signal is returned since they cancel one another out. To some extent this effect can be overcome by raising the height of such a radar reflector from the surface of the sea.

It is also known from GB-A-1468516 to mount a trihedral re-entrant radar reflector assembly inside a cylindrical housing including wind vanes and mounted for rotation so that, in use, the reflector is rotated around an upright axis by the wind.

SUMMARY OF THE INVENTION

According to this invention a radar reflector comprises a hollow, generally spherical or conical radar transmitting housing containing a radar reflecting assembly having a number of trihedral cube corner reflecting elements arranged in strings one above the other and with a number of the strings arranged side-by-side around the inside of the housing.

The radar reflector in accordance with this invention is particularly useful with navigational buoys. The radar reflector may form at least part of the buoy and, in this case the hollow housing may be formed by at least the upper part of a conventional can or ogive-shaped buoy which projects above the surface of the water. However, it is preferred that the radar reflector is provided as a top mark for a navigational buoy. Navigational buoys, particularly those used in the Cardinal system of buoyage have top marks formed by combinations of spheres and cones which serve to identify the nature of the hazzard and its relative direction from the position of the buoy. Such top marks are mounted on posts projecting upwards from a main body of the buoy. In this case the housing of the radar reflector is preferably made from plastics material such as polyethylene and is typically made by a rotational moulding process in which, the radar reflecting assembly is mounted inside a hollow two-part mould which is then heated and into which is placed a shot of powdered plastics material. The mould is then rotated in all directions so forming a continuous plastics lining covering over the entire inner surface of the mould. After subsequent cooling and demoulding a join free continuous housing is obtained.

The size of the radar reflecting elements in each string may vary. For example, when the housing is generally conical the element at one end of each string may be the smallest and that at the other end the largest; and, when the housing is generally spherical the largest element may be in the middle of each string and smaller elements located at both ends. A generally spherical reflector may also be filled by two generally conical radar reflecting assemblies arranged base to base. By varying the size of the reflecting elements in each string the size of the radar reflecting assemblies is both tailored to the size of the housing when this also serves as a top mark, increases the radar cross-section of the reflector, and ensures that a strong radar reflection is obtained with a range of wavelengths of radar.

A radar reflector in accordance with this invention has a sufficiently fine structure of its $4\pi$ polar diagram to be capable of resolving a narrow angle between incident beams and consequently enables a detectable return to be generated even when the reflector is mounted close to the surface of the sea under conditions of high sea surface specular reflection caused by a calm sea or ice. This effect is further enhanced by typically using two top marks on each buoy and having both formed as radar reflectors in accordance with this invention. The provision of the two radar reflectors one above the other increases the lateral separation between reflecting elements and provides phase distinct paths from which a detectable return is more certain.

In one example the radar reflecting assembly comprises strings of reflecting elements with the origins of all of the reflecting elements lying on and being arranged around a frusto-conical surface and with all of the reflecting elements facing outwards. In this case the reflecting assembly is preferably formed from electrically conducting sheet material folded into a pleated frusto-conical body, adjacent outwardly facing folds including a right angle, and two or more separator plates located between the adjacent outwardly facing folds and normal to the fold line between them to form the cube-corner reflecting elements.

With this reflecting assembly it is the cone angle of the cone containing the fold lines including a right angle, the inner fold lines, which, together with the spacing of the separator plates, determines its performance. Preferably this cone angle is within a range of 45° to 55° and it is further preferred that it is between 50° and 62°. A cone angle of exactly 54.7° ensures that when the radar reflecting array is strictly vertical the centre of the reflection lobe from each reflecting element is horizontal. By then arranging for the separator plates to be spaced so that radar reflected from adjacent cube corner reflectors in each string is a whole number of wavelengths out of phase, constructive interference takes place between these to enhance the reflected signals and so provide the maximum horizontal return. The angle of the cone containing the other fold lines of the pleated array, the outer fold lines, is preferably matched to that of the inside of the housing. By having the cone angle of the cone containing the outer fold lines larger than that containing the inner fold lines each fold tapers towards the smaller frusto-conical end of the pleated body to provide the reflecting elements of different size.

As a result of the constructive interference that occurs between adjacent reflecting elements this type of reflector is preferred where it can be mounted so as to be substantially vertical in use. When such a reflector is tilted appreciably from the vertical the phase difference between the radar signals reflected from adjacent reflecting elements does not differ by a whole number of wavelengths. As the angle of heel increases a point can be reached where there is an odd number of half wavelength's difference between the radar signals reflected from adjacent elements and then they destructively interfere to cancel the return echo. To avoid this difficulty it is preferred that a second example of reflecting assembly is used when it heels from the vertical in use.

In the second example the radar reflecting assembly comprises at least three strings of single or double handed helical reflecting element arrays arranged side-by-side. The axes of the strings of reflecting element arrays may each be generally straight and in this case the axes may be arranged substantially parallel to one another or they may be arranged at an angle to one another, so that their axes lie on a frusto-conical surface. Typically each string is formed by folding a strip of electrically conducting material into a number of trapezium-shaped plates each of which is folded at right angles to its neighbours and then fixing separator plates normally to the fold lines in between each adjacent pair of trapezium-shaped plates to form cube-corner reflecting elements. With this arrangement the axes of the reflecting elements in each string are spread around the azimuth with some pointing generally upwards above the horizontal plane and some generally downwards below it. The provision of at least three helical arrays ensures that at least two of the arrays receive incident radar radiation at any instant irrespective of its incident angle and ensures that a larger radar return or echo is generated simply as a result of reflections from the at least two reflectors. However, in addition to this, by arranging each of the arrays with the axes of their cube corner reflectors oriented in different directions this increases the likelihood of the incident radiation approaching at least one reflecting element axially. Further, since there are such a large number of reflecting elements an overlap exists between their returned signals leading to constructive interference where there is a phase difference of a whole number of wavelengths between them. As a result of this with the arrangement in accordance with the second example a substantially uniform echo is obtained around its entire azimuth over a range of angles of heel.

To vary the sizes of the reflecting elements in each string they may be made by folding a tapering strip of sheet material. The strip may taper from one end to the other so that, after folding the elements at one end of the string are smaller than the elements at the other end of the string. Alternatively, the strip may be widest at its centre and taper to both ends to provide a string with the largest reflecting element in the middle and the smallest at both ends. The former of these is more suited to construction of a generally frusto-conical form of the radar reflecting assembly and the latter to a generally spherical form of radar reflecting assembly. Consequently it is preferred that the former is used with a generally conical housing and the latter used with a spherical housing.

Preferably each helical string includes only five folds with a projected half twist angle of substantially 11°. This provides each string with a non-uniform reflection characteristic around its azimuth. With this arrangement the strings are arranged with their parts providing the greatest reflection pointing outwards.

BRIEF DESCRIPTION OF THE DRAWINGS

Particular examples of radar reflectors in accordance with this invention will now be described with reference to the accompanying drawings in which.

DESCRIPTION OF PREFERRED EXAMPLES

Figure 2:
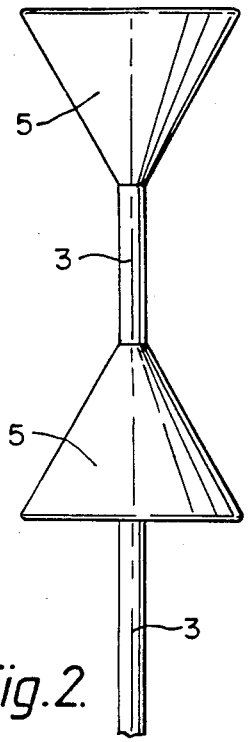
FIG. 2 is a side elevation of alternative top marks.
Figure 3:
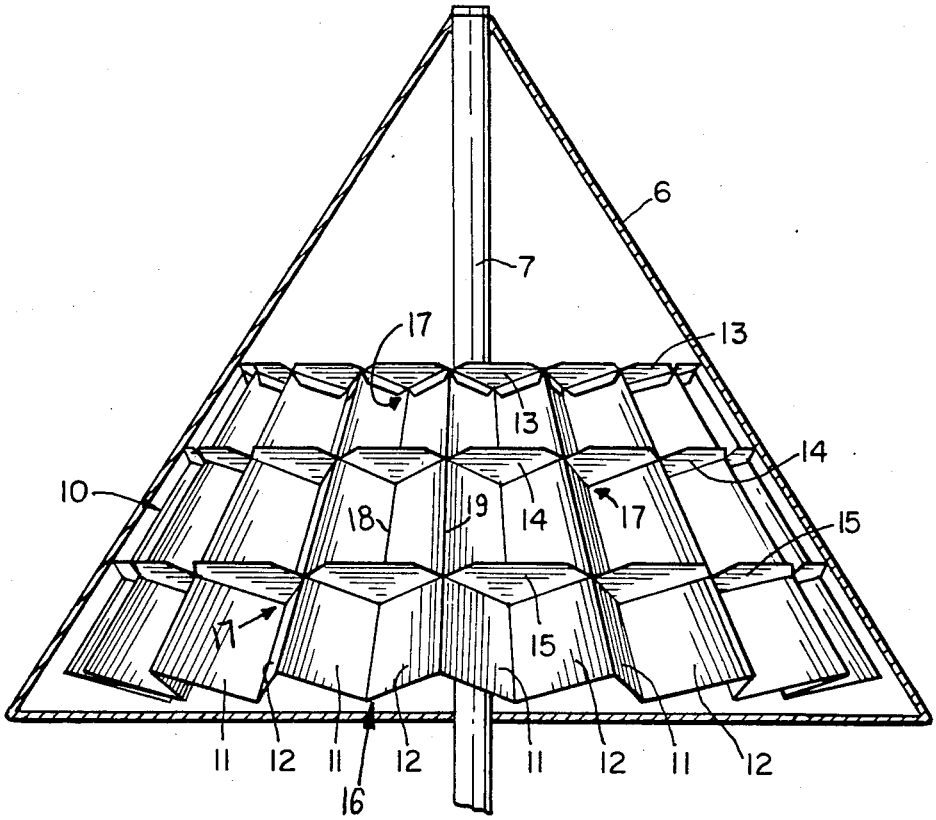
FIG. 3 is a partly sectioned side elevation of a conical top mark including a first example of radar reflecting assembly.

A navigational buoy for use in the Cardinal system comprises an ogive-shaped body 1 moored to the sea bed by mooring chains 2. A mounting post 3 projects vertically from the body 1 and carries spherical top marks 4. Conical top marks 5, shown in FIG. 2, may be mounted on the post 3. Typically the cones 5 are mounted as shown in FIG. 2 with their points together, mounted with both of their points pointing upwards or downwards or mounted with their bases together to indicate that the buoy is to the west, the north, the south or the east, respectively, of the navigational hazard.

The top marks 4 and 5 each comprise a hollow, radar transparent housing 6 formed around a tube 7 with a radar reflecting assembly 10 mounted on the tube 7 and located inside the housing 6. Preferably the radar reflecting assembly 10 is formed from sheet metal such as sheet aluminium and the tube 7 is also formed from aluminium. In use, the tube 7 is fitted over the mounting post 3. The housing 6 is formed by rotational moulding with the reflecting assembly 10 and tube 7 fixed inside a rotational mould into which a charge of moulding powder, such as polyethylene, is inserted and the mould heated and rotated in all directions to coat the inner surface of the mould with polyethylene to form a continuous join-free housing 6. The radar reflecting assembly 10 may buttress the side wall of the housing 6.

Figure 1:
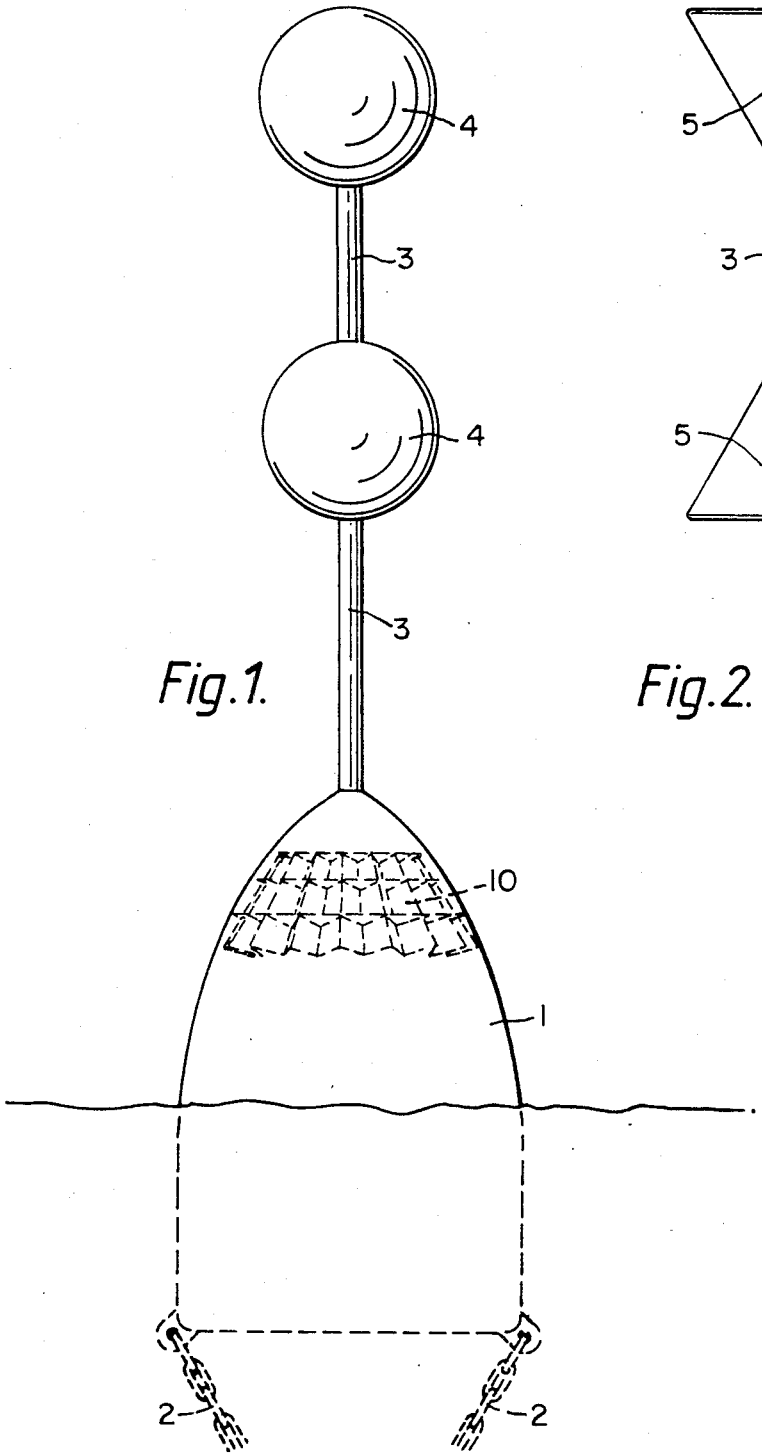
FIG. 1 is a side elevation of a navigational buoy with top marks including radar reflectors.

Instead of mounting the radar reflecting assembly 10 inside the top marks 4 and 5 it can also be located inside the part of the body 1 of the buoy which projects above the surface of the sea as indicated in FIG. 1. In this case the ogive-shaped top portion of the body of the buoy, at least, is formed from radar transparent material.

Figure 4:
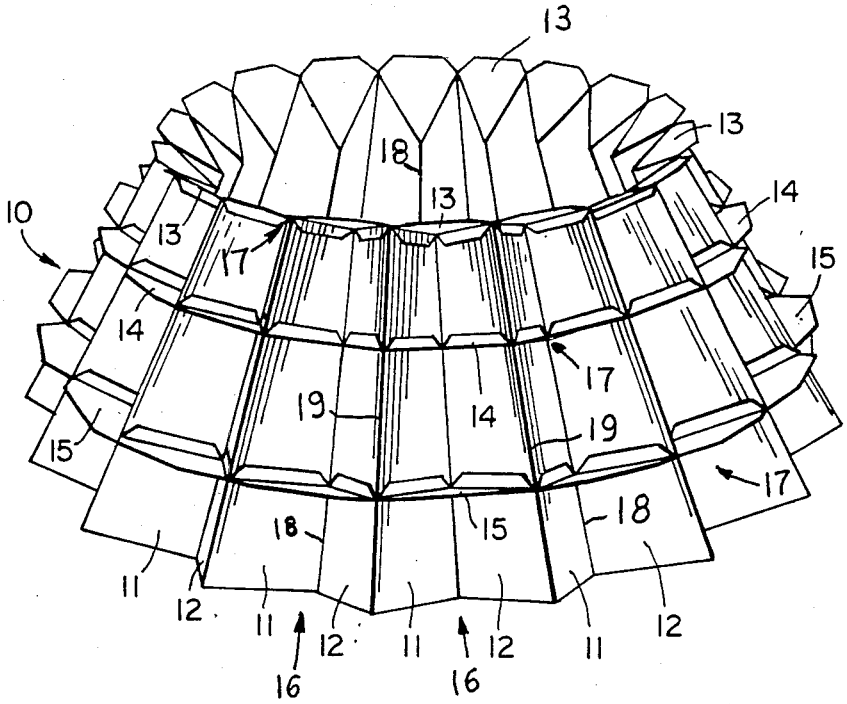
FIG. 4 is a perspective view of the first example of radar reflecting assembly.

The first example of radar reflecting assembly 10 is shown more clearly in FIG. 4 and comprises a sheet of material folded into a number of similar but laterally reversed trapezium-shaped panels 11 and 12 with the complete assembly having a generally frusto-conical form. A right angle is included between each of the panels 11 and 12 and three separator plates 13, 14 and 15 are fixed between each adjacent pair of panels 11 and 12 to form upright strings 16 of three cube-corner reflecting elements 17.

A trihedral cube-corner reflecting element is thus formed by each separator plate 13, 14, and 15 and the portions of the panels 11 and 12 adjacent it. Each of these trihedral cube-corner reflecting elements 17 acts as a retroreflector to return incident radar signal. Inner folds 18 formed between adjacent plates 11 and 12 lie on a cone having an angle of 54.7 degrees to ensure that when the axis of the cone is vertical the centre of the reflection lobe from each reflecting element 17 lies in a horizontal plane so that the maximum return is provided by the radar reflecting assembly 10 with a generally horizontal incident beam. Outer folds 19 forming the external join between the plates 11 and 12 all lie substantially on the surface of a cone having the same core angle as the housing 6 and the outermost edges of the separator plates 13, 14 and 15 may engage the inner surface of the housing 6.

Figure 5:
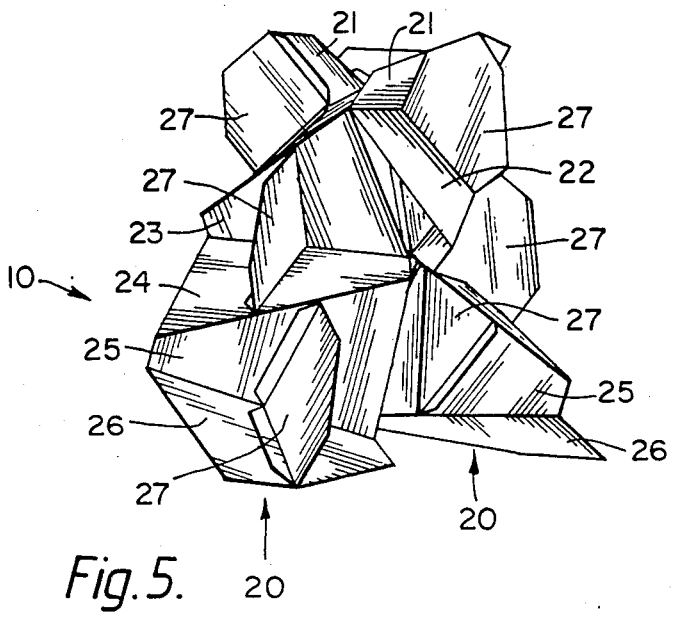
FIG. 5 is a side elevation of a second example of radar reflecting assembly.
Figure 6:
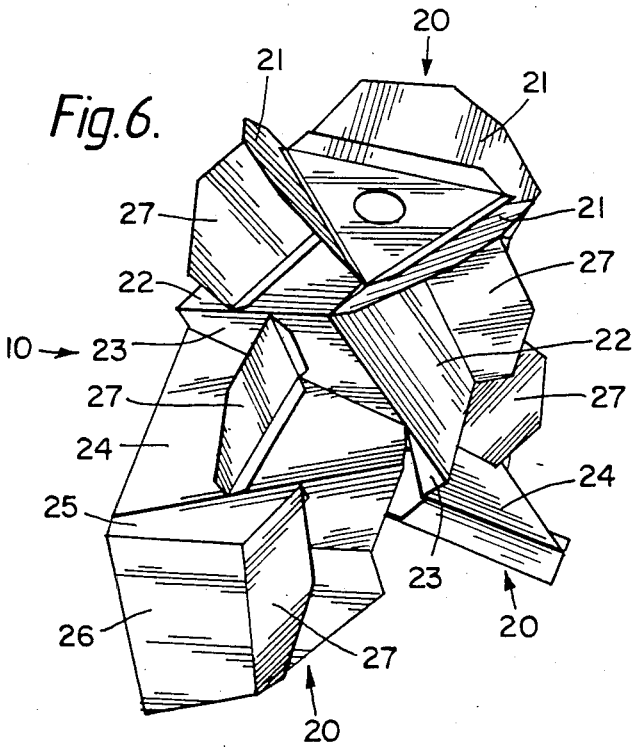
FIG. 6 is a perspective view of the second example of radar reflecting assembly.
Figure 7:
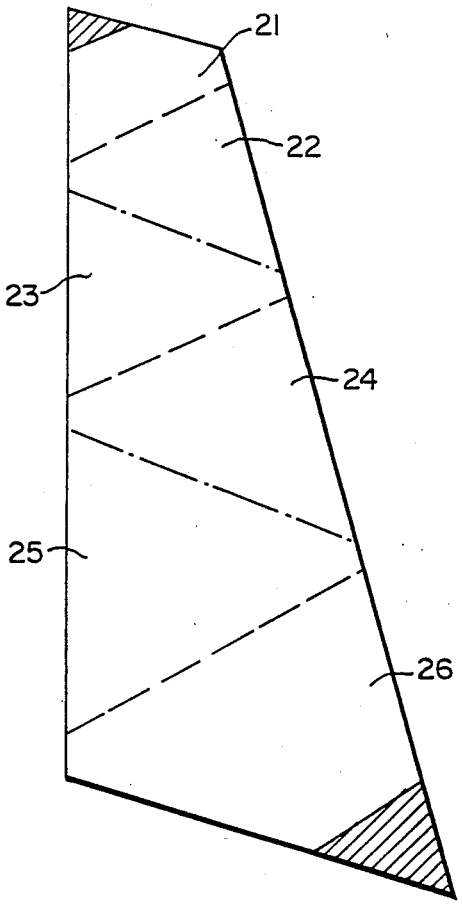
FIG. 7 is a plan of a blank for forming one string of the second example of radar reflecting assembly; and, FIG. 8 is a plan of a blank for forming a third example of radar reflecting assembly.

The second example of radar reflecting assembly shown in FIGS. 5 and 6 comprises three similar, equiangularly spaced helical cube corner reflecting arrays or strings 20. Each array 20 is formed by folding a generally tapering strip of material, as shown in FIG. 7 into six trapezium-shaped plates 21, 22, 23, 24, 25 and 26 with right angled corners being formed between each adjacent pair of plates. In FIG. 7 the dotted lines indicate a fold in one direction and the chain-dotted lines indicate a fold in the opposite direction. Separator plates 27 are located midway along each fold and lie in a plan normal to the fold line.

Shaded regions of trapezium shaped plates 21 and 26 are cropped and each of the separator plates 27 is shaped so as to enable the entire reflecting assembly to be fitted inside a conical envelope formed by the housing 6. In the second example the half-twist angle of the helical array, that is half of the angle between the projections of two adjacent fold lines onto a horizontal plane, is equal to 11 degrees. This provides each helical cube corner reflecting array 20 with more cube corner reflecting elements 17 pointing generally outwards away from the other reflectors than pointing inwards. The reflecting arrays 20 are equiangularly spaced around the azimuth.

Figure 8:
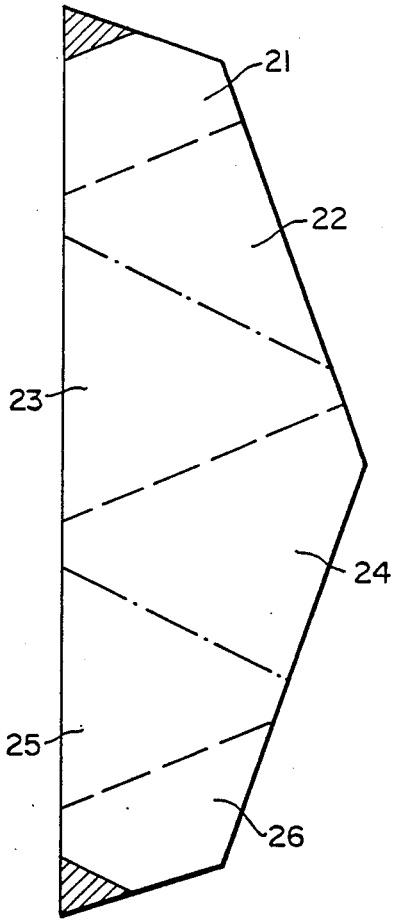

In a third example of reflecting assembly in accordance with this invention blanks 28 such as shown in FIG. 8 are formed into helical cube corner reflecting arrays. With this arrangement the helical cube corner reflecting arrays have a greater width in the middle length and so are more suited to being located inside a spherical housing 6 to form a spherical top mark 4. Alternatively, one generally conical reflecting array can be fitted inside each spherical top mark 4 or, preferably, two generally conical arrays arranged base to base are located inside each spherical top mark 4.

I claim:

1. A radar reflector comprising a hollow, generally spherical radar transmitting housing, and a radar reflecting assembly disposed within said housing, said radar reflecting assembly being mounted inside said housing and comprising means, comprising a plurality of trihedral cube corner reflecting elements, for maximizing retroreflection of substantially horizontal radar transmission and for providing a substantially uniform retroreflection at all angles around a horizontal plane, said trihedral cube corner reflecting elements having axes and being arranged one above the other in strings having a first end and a second end, said first end being located above said second end, said axes of said cube corner reflecting elements being generally horizontal and active elements of said cube corner reflecting elements being disposed to face outwards in the corresponding string, a plurality of said strings being of said trihedral cube corner reflecting elements being arranged side-by-side around the inside of said housing, said hollow housing being formed as the top mark for a navigational buoy in the Cardinal system of buoyage.

2. The radar reflector of claim 1, wherein said housing is made from plastics material by a rotational moulding process.

3. The radar reflector of claim 1, wherein said reflecting elements located intermediate said first and second ends of each of said strings are larger than said reflecting elements located at said first and second ends of each of said strings.

4. A radar reflector comprising a hollow generally conical radar transmitting housing, and a radar reflecting assembly, said radar reflecting assembly being mounted inside said housing and comprising means, comprising a plurality of trihedral cube corner reflecting elements for maximizing retroreflection of substantially horizontal radar transmissions and providing a substantially uniform retroreflection at all angles around a horizontal plane, said tetrahedral cube corner reflecting elements having axes and being arranged one above the other in strings having a first end and a second end, said first end being located above said second end, said axes of said cube corner reflecting elements being generally horizontal and active elements of said cube corner elements being disposed so as to face outwards in the corresponding string, a plurality of said strings of said trihedral cube corner reflecting elements being arranged side-by-side around the inside of said hollow housing, said hollow housing being formed as a top mark for a navigational buoy in the Cardinal system of buoyage.

5. The radar reflector of claim 4, wherein said housing is made from plastics material by a rotational moulding process.

6. The radar reflector of claim 4, wherein said reflecting elements at said first end of each said string are larger than said reflecting elements at said second end of each said string.

7. A radar reflector comprising a hollow, generally spherical radar transmitting housing, and a radar reflecting assembly, said radar reflecting assembly being mounted inside said housing and having a plurality of trihedral cube corner reflecting elements arranged one above the other in strings having a first and second end, and a plurality of said strings of said trihedral cube corner reflecting elements arranged side-by-side around the inside of said housing, origins of all of said reflecting elements lying on and being arranged around a frusto-conical surface with all of said reflecting elements facing outwards.

8. The radar reflector of claim 7, wherein said radar reflecting assembly is formed from electrically conducting sheet material folded to form a pleated frusto-conical body, adjacent outwardly facing plates of said pleated frusto-conical body including a right angled fold, and two or more separator plates being located between said adjacent outwardly facing plates and located in a plane normal to said right angled, fold.

9. The radar reflector of claim 8, wherein the cone angle of a cone containing said right angled folds is in a range from 50° to 62°.

10. The radar reflector of claim 9, wherein said cone angle is substantially 54.7°.

11. The radar reflector of claim 7, which includes two radar reflecting assemblies arranged one above the other with their bases adjacent.

12. A radar reflector comprising a hollow generally conical radar transmitting housing, and a radar reflecting assembly, said radar reflecting assembly being mounted inside said housing and having a plurality of trihedral cube corner reflecting elements arranged one above the other in strings having a first and second end, and a plurality of said strings of said trihedral cube corner reflecting elements being arranged side-by-side around the inside of said housing, origins of all of said reflecting element lying on and being arranged around a frusto-conical surface with all of said reflecting elements facing outwards.

13. A radar reflector comprising a hollow generally conical radar transmitting housing, and a radar reflecting assembly, said radar reflecting assembly being mounted inside said housing and having a plurality of trihedral cube corner reflecting elements arranged one above the other in strings having a first and second end, and a plurality of said strings of said trihedral cube corner reflecting elements being arranged side-by-side around the inside of said housing, wherein said radar reflecting assembly is formed from electrically conducting sheet material folded to form a pleated frusto-conical body, adjacent outwardly facing plates of said pleated frusto-conical body including a right angled fold, and two or more separator plates being located between said adjacent outwardly facing plates and located in a plane normal to said right angled fold.

14. The radar reflector of claim 13, wherein the cone angle of a cone containing said right angled folds is in a range from 50° to 62°.

15. The radar reflector of claim 16, wherein said cone angle is substantially 54.7°.

16. A radar reflector comprising a hollow, generally spherical radar transmitting housing, and a radar reflecting assembly, said radar reflecting assembly being mounted inside said housing and having a plurality of trihedral cube corner reflecting elements arranged one above the other in strings having a first and second end, and a plurality of said strings of said trihedral cube corner reflecting elements arranged side-by-side around the inside of said housing, said radar reflecting assembly comprising at least three strings of cube corner reflecting elements, said reflecting elements in each string being arranged as a helical array.

17. The radar reflector of claim 16, wherein each said string is formed by folding a strip of electrically conducting material into a plurality of trapezium-shaped plates, each trapezium-shaped plate being folded at right angles to adjacent trapezium-shaped plates, with separator plates mounted in between each adjacent pair of trapezium-shaped plates in planes normal to fold lines between each adjacent pair of trapezium-shaped plates to form said cube-corner reflecting elements.

18. The radar reflector of claim 17, wherein each strip of electrically conducting material is widest at its mid portion.

19. The radar reflector of claim 17, wherein each strip of electrically conducting material tapers from one end to the other end.

20. The radar reflector of claim 19, wherein two radar reflecting assemblies are mounted in said housing with their bases adjacent.

21. The radar reflector of claim 17, wherein there are only three strings of reflecting elements, and wherein each said string is single handed helical array and includes six trapezium-shaped plates with only five folds between them and with a projected half twist angle of substantially 11° between adjacent folds.

22. A radar reflector comprising a hollow generally conical radar transmitting housing, and a radar reflecting assembly, said radar reflecting assembly being mounted inside said housing and having a plurality of trihedral cube corner reflecting elements arranged one above the other in strings having a first and second end, and a plurality of said strings of said trihedral cube corner reflecting elements arranged side-by-side around the inside of said housing, said radar reflecting assembly comprising at least three strings of cube corner reflecting elements, said reflecting elements in each string being arranged as a helical array.

23. The radar reflector of claim 22, wherein each said string is formed by folding a strip of electrically conducting material into a plurality of trapezium-shaped plates, each trapezium-shaped plate being folded at right angles to adjacent trapezium-shaped plates, with separator plates mounted in between each adjacent pair of trapezium-shaped plates in planes normal to fold lines between each adjacent pair of trapezium-shaped plates to form said cube-corner reflecting elements.

24. The radar reflector of claim 23, wherein each strip of electrically conducting material tapers from one end to the other end.

25. The radar reflector of claim 23, wherein there are only three strings of reflecting elements, and wherein each said string is single handed helical array and includes six trapezium-shaped plates with only five folds between them and with a projected half twist angle of substantially 11° between adjacent folds.

26. The radar reflector of claim 24, wherein there are only three strings of reflecting elements, and wherein each said string is single handed helical array and includes six trapezium-shaped plates with only five folds between them and with a projected half twist angle of substantially 11° between adjacent folds.

* * * * *